United States Patent [19]

Eickmann

[11] Patent Number: 4,723,477

[45] Date of Patent: Feb. 9, 1988

[54] CONTROL BODY ARRANGEMENT FOR PUMPS, MOTORS OR ENGINES

[76] Inventor: Karl Eickmann, 2420 Isshik, Hayama-machi, Kanagawa-ken, Japan

[21] Appl. No.: 802,408

[22] Filed: Nov. 27, 1985

Related U.S. Application Data

[60] Continuation-in-part of Ser. No. 573,743, Jan. 25, 1984, abandoned, which is a division of Ser. No. 171,697, Jul. 24, 1980, abandoned.

[51] Int. Cl.[4] ..... F01B 1/00

[52] U.S. Cl. ..... 91/485; 91/486

[58] Field of Search ..... 91/485–487, 91/491

[56] References Cited

U.S. PATENT DOCUMENTS

| | | | |
|---|---|---|---|
| 2,861,552 | 11/1958 | Creighton et al. | 91/485 |
| 3,092,036 | 6/1963 | Creighton | 91/485 |
| 3,170,297 | 2/1965 | Larson | 91/485 |
| 3,960,060 | 1/1976 | Eickmann | 91/487 |
| 4,181,067 | 1/1980 | Ortelli | 91/485 |

FOREIGN PATENT DOCUMENTS

| | | | |
|---|---|---|---|
| 2256682 | 7/1975 | France | 91/487 |
| 1391985 | 4/1975 | United Kingdom | 91/487 |
| 1439672 | 6/1976 | United Kingdom | 91/487 |

*Primary Examiner*—Carlton R. Croyle
*Assistant Examiner*—Paul F. Neils

[57] ABSTRACT

A control arrangement to control the flow of fluid through pumps, motors, transmission, engines has an eccentric shoulder assembled into a respective thrust chamber in a portion of the housing to be pressed against the rotary seal face of the rotor of the device. Such arrangements are known from some of my earlier patents and have served satisfactorily, but with the desire to improve the pressures further, it has been found, that arrangements are required to prevent the control body from slight rotation, under which it otherwise would stick. The arrangement provides the means to prevent the rotation and sticking by defining a relationship between eccentricities and gravity centers in order to reduce the tendency to stick. Pins and pins with eccentric and adjustable portions are also used to prevent the tendency to stick and so are pluralities of eccentrically arranged individual thrust chambers and control body portions. A specific feature of the embodiment which is claimed consists in a control body with only two seats for reversible directions of flow of fluid and for high performance of operation with low friction an small leakage.

2 Claims, 41 Drawing Figures

$$r_{gc} = \frac{2}{3}\,\frac{(R_o^3 - R_i^3)}{(R_o^2 - R_i^2)}$$

$G_c = r_{gc} \times F_G$ $F_G(90°) = 0{,}6369$

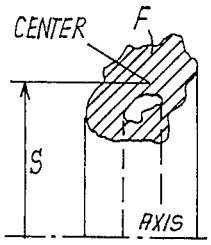
Fig. 28-A
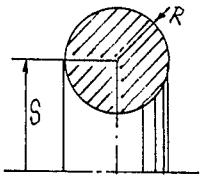
Fig. 28-B
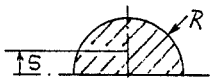
Fig. 28-C
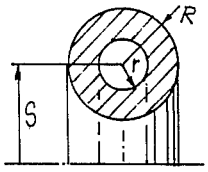
Fig 28-D
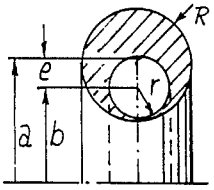
Fig. 28-E
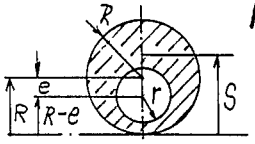
Fig. 28-F
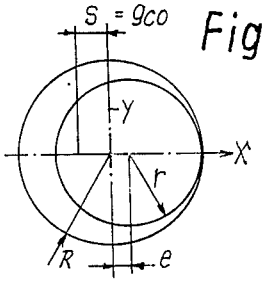
Fig. 29-A
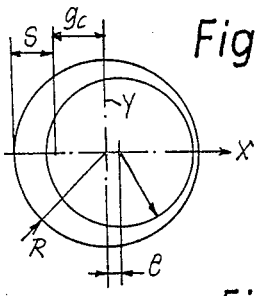
Fig. 29-B
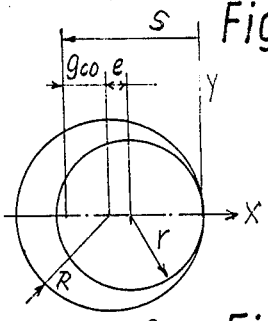
Fig. 29-C
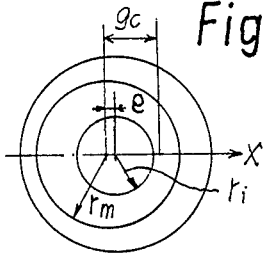
Fig. 29-D
Fig. 29-E
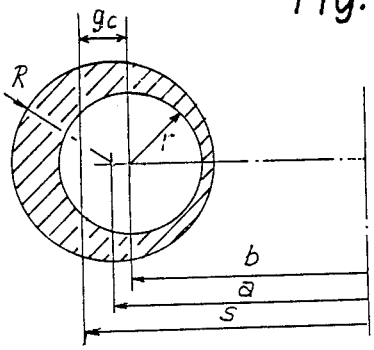

CONTROL BODY ARRANGEMENT FOR PUMPS, MOTORS OR ENGINES

REFERENCE TO A RELATED APPLICATION

This is a continuation in part application of my copending application Ser. No. 06-573,743, filed on Jan. 25, 1984, and now abandoned, which is a divisional patent application of my earlier patent application, Ser. No. 171,697 which was filed on July 24, 1980; benefit of which is claimed herewith. Application Ser. No. 171,697 is now abandoned.

FIELD OF THE INVENTION

This invention relates to control body arrangements in machines, where fluid flows through working chambers of the device. For example to hydrostatic pumps, motors, transmissions or pneumatic compressors, motors, engines and transmissions. More in detail the invention relates to those control body arrangements, where the control body has a control face on its front end to control the flow of fluid in relation to a rotary face, wherealong the control face of the control body is sealing. On the rear end or on medial portions of the controlbody there are seats provided with which the control body is entred into respective chambers in a portion of the housing of the machine. At least one chamber is a thrust chamber, which presses the controlbody towards the mentioned rotary face, whereby the sealing therealong is obtained and the control of the flow is effected.

The field of the invention thereby is a control body for axial flow of fluid to and from a rotor of a device, with the control body pressed by fluid pressure in a thrust chamber against the rotary face to seal therealong. And more in particular, the field of the invention is restricted to such control bodies, wherein at least one eccentric control body portion and an associated thrust chamber are provided.

DESCRIPTION OF THE PRIOR ART

It has been attempted long times ago and actually been done, to provide kidney-shaped thrust chambers and body-portions therein, to lead fluid to and from the kidney—shaped control ports in pumps and motors. While such arrangements would be the ideal solutions for proper and unrestricted flow of fluid combined with excellent axial alignment of the pressure centers involved, the fact is, that kidney-shaped chambers and body-portions are difficult to be machined. This is especially the case, because for the high pressure pumps and motors of the present time the seats must be extremely accurate and have extremely small clearances and close fits. Thereby it has become almost impossible to actually build and use the kidney-shaped chambers and control body portions.

The desire to replace the almost unmanagable production costs of kidney-shaped control body means has led to circular forms of chambers and portions, which are easy to be made and which can be machined with little cost to the required accuracy and fits.

One of the earliest and proper solutions of this kind is shown by Naylor and Fieldhouse of Vickers Armstrongs Ltd of London in West German Pat. No. 829,553 of 1951. It has two thrust chambers individually sealed and oppositionally diametrically located behind the control body. They act parallel to the axis of the rotor. The arrangement can provide properly located pressure centers. However, the patent does not discuss the requirement of proper location of the chambers in relation to pressure centers. Reviewing the patent with the present knowledge of the writer of this present patent application, the mentioned patent can provide a most excellent control body with proper functioning. However, the thrust chambers are required to be radially offset and thereby they are requiring a big radial space which is often not available in present day compact pumps and motors. Further, the said patent can be used only for relatively radially narrow ports, because for radially wide ports, the chambers would move out of the required axial alignment with the pressure centers of the control face.

It is also known to provide one or more centric thrust chambers to press the control body against the rotary face or a rotor against a stationary control face. For example from (West) German Pat. No. 824,295 of 1950 or from U.S. Pat. No. 3,951,044 of 1976 of myself. However, such centric thrust chambers can be used only, when the control body is so accurately guided, that it can not tilt. Because concentric chambers have a pressure center at the rotor-axis, while the control face of the control body has a pressure center distanced from the rotor-axis. Thus, the control face would be pressed locally different onto the rotary face, when a control body with a pressure center unequal to the pressure center of the control face would be used without guiding the control body mechanically so accurately, that local different forces are prevented.

It was then found in 1955 by Vetter and Borowka of the Saalmann Company of Velbert in (West) Germany and shown in their German Pat. No. 968,539, that the control body should have an eccentric shoulder in order to locate the pressure centers of the thrust chambers of a flow-direction reversible control body behind the pressure centers of the control face of the control body.

With the present discoveries of the writer of the present patent application, however, it must now become recognized, that the solution, which the said patent proposed, is an error. Because the patent utilized a thrust chamber behind the rear end of the control body and an eccentric chamber in addition. At such arrangement the pressure centers of the thrust chambers are closer to the axis of the rotor than the pressure centers of the control face portions. Thus, as the present writer now judges, the mentioned patent can not have provided a working control body because of its basic error of assumption of pressure centers at places and locations, where they do not actually exist.

A much more accurate solution, than the Vetter Borowka patent was then proposed during 1960 by Creighton in his U.S. Pat. No. 3,092,036. He aligned the pressure centers by the provision of blind pressure ports on the opposite half of the control face. Thereby, as the present writer today judges, the pressure centers of the control face moved closer to the rotor axis and could become equally distanced from the rotor-axis relatively to the existing pressure centers of the thrust chambers. However, that could have been done only for certain sizes and relationships of the control ports of the blind pockets. Thereby the application is restricted to limited radial size of the control ports. Further, the application of the blind pockets results in extension of seal faces and in the provision of additional leakage flows through the control face and the rotary face. The system also requires larger pressure chambers, than the elder Vetter- Borowka patent and thereby the thrust onto the bearings on the other end of the rotor increases. In short, while the Creighton patent brings a proper possibility for certain sizes of radial extension of the control ports, it increases the losses in the machine. And, in addition, the Creighton patent fails to bring proper mathematical formulas to show where the pressure centres are located and where the chambers have to be located properly.

All problems of the Vetter-Borowka and of the Creighton patents were overcome by my U.S. Pat. Nos. 3,831,496; 3,850,201; 3,889,577 and 3,960,060 of 1974 to 1976. These patents give accurate and extensive formulas and extensive teaching for actual building of the devices and arrangements. They provide an extensive basis and teaching for the technology involved, for accurate discovery and location of the pressure centers on different ends of the control body and they provide a proper knowledge for the actual designing and machining of the control bodies and the associated chambers.

SUMMARY OF THE INVENTION

After the accurate teaching for proper action was given in my mentioned earlier patents, the application of control bodies in actually built pumps, motors and transmissions increased. With the features obtained, the pumps and motors became smaller in size for a given power. That in turn created a desire to narrow the dimensions of the control bodies further. It became also a desire to extend shafts through the hollow control bodies. Thereby the relative radial extension of the respective control ports decreased. Also the pressures and speeds were increased in the pumps and motors.

It then occasionally happened, that the control bodies of my earlier patents bound in their seats. That was noticed, when the pumps or motors were disassembled years later after their production. Such sticking, when it occures, makes the control body to a non-moveable part, self-lockingly bound in the seats in the housing portion.

This occurance was a matter of concern to me for many years. Because it was not known, what the reason for this sticking was. The pressure centers on "gravity-centers" were very properly aligned. But still the control bodies or some of them, stuck sometimes.

It is now the discovery of this present patent application, that it is not enough to align the pressure centres properly as taught in my earlier patents. Because, there is another influence which can have a much greater effect onto the control body, than unproper location of the pressure-centers. This now discovered fact is, that, when the friction along the control face reaches just a few footpounds or kilogramcentimeters, the torque trends to revolve the control body slightly in its seats. When that happens, the relative to each other eccentric cylindrical faces of the seats then move along each other and partially towards each other under a very small angle of relative inclination.

It is just, as pressing a tapered cone of small angle of inclination into a complementary hollow seat. For example as done with the tools in lathe machines, drill-spindles and the like.

Such tools with sharp cones are not used to slide, but they are used to fasten themself by self-lock under the increased forces which increase under the sharp inclination of the faces.

The same matter appears on the control bodies in their seats, when the control bodies are actually revolving under the torque by friction along the control face of the control body. At the sharp angles between the faces of the seats the force of the friction along the control face muliplies a hundred times, a thousand times or even ten thousand times, because the sharpness of the relative angles between the faces in the seats of the control body is much, much sharper than in the mentioned drillspindle-cones.

A very slight rotation, of for example, one degree or a fraction thereof, can already force the sticking of the control body. The control body can then not any more loosen itself. It remains bound until it becomes unlocked by rotation in the opposite direction.

It is therefore the object and aim of this invention, to present the sticking of the control body by preventing the destructive trend of rotation of the control body.

The object and aim of the invention is obtained by two basic principles:

(a) to dimension the controlbody in such a style, that the eccentricity in combination with reduction of friction along the control face restricts the tendency of the control body to revolve slightly and then to stick; or, (b) when the a principle does not assure the desired aim, to provide an arresting means of mechanical nature for the prevention of eccessive rotation of the control body.

There are a plurality of means, which are applied either single or in combination, to obtain the aim and object of the invention.

Still another solution is at least partially to utilize the equations of my mentioned earlier patents to a highest possible degree of accurateness. For example to build the control bodies and chambers in such perfectness, that their sizes and locations meet the conditions of the equations with at least 90 percent accuracy.

One discovery of the invention thereby is, that the sticking of the control body can become prevented by a high degree of correspondance of the actual building with the equations in combination with proper eccentricities to narrow or reduce the tendency to rotate and to stick.

BRIEF DESCRIPTION OF THE DRAWING

FIG. 15 is a portion of FIG. 24 showing another flow direction.

FIGS. 28-A to 28-F show schematics with mathematical explanations.

FIGS. 29-A to 29-E show also schematics with explanations.

DESCRIPTION OF THE PREFERRED EMBODIMENTS

Figure 2:
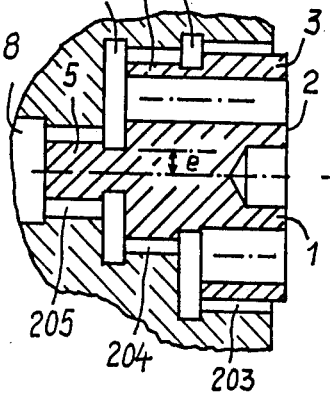
FIG. 2 shows a control body in its seats with extremely enlarged clearances of the seats.
Figure 1:
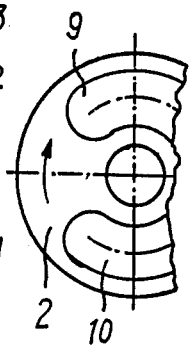
FIG. 1 shows a portion of the basic control face of a control body.
Figure 3:
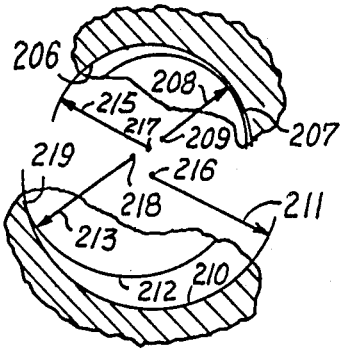
FIG. 3 is an explanatory Figure to explain the sticking of the control body under rotation along the arrow of FIG. 1.

Control body 1 in FIGS. 1 to 3 has a front portion 3, a medial portion 4 and a rear portion 5. The front of the control body has the control face 2 which is also visible in FIG. 2. Control body 1 is inserted into the housing portion 9 and forms therein the chambers 6 and 7 and the seats 203,204,205. The seats are drawn in FIG. 1 with very big enlarged clearances 203 to 205. Actually the clearances are only about a few hundredth of a millimeter in size.

FIGS. 1 to 3 are explanatory Figures and are supplied to illustrate the action which is discovered by the present invention.

When the rotary face of the rotor runs over the control face 2 in the direction of the arrow in FIG. 1 the control body follows this rotation along the direction of the arrow in FIG. 1. At least one of the portions 3,4,5 of the control body is eccentric relatively to at least one of the other mentioned portions. For example, portions 3 and 5 may be centric, but portion 4 eccentric to the axis of the rotor and to the axis of the other portions 3 and 5.

Attention is now requested to FIG. 3. The housing 9 has formed the centric seat face(s) 210 with radius 211 around the concentric axis 216 and the eccentric seat face 206 with radius 215 around eccentric axis 217. Under the rotary motion by following the arrow in FIG. 1, one of the outer faces of a respective control body portion becomes close to one of the seat faces in the housing 9. The control body then slides along it and displaces itself, until finally the former centric axis of the control body 1 moves from axispoint 216 to 218 and the eccentric axis moves from former location 217 to dislocation 209. The eccentric portion 4 of the control body then touches with its shoulder of radius 208 around dislocated axis 209 the inner face 206 under a very small angle of relative inclination between the faces. The formerly centric portion touches also under a very sharp angle of relative inclination between the faces with the shoulder of radius 213 around the dislocated axis 218 against the inner face 210 of the seat in the housing 9. With the big enlarged clearances shown in the Figures, the angles of inclination between the faces appear to be roughly one or a few degrees in the Figures, because the clearances are shown larger in the Figures than they actually are and enlarged clearances show enlarged angles of pivotal movement. The sticking (binding) appears in lines 207 and 219. The element numeral 208 is the radius of the seat of the control body around the dislocated axis 209. The element numeral 210 is the seat face of the respective seat of the housing portion and face 212 is the respective seat face of the respective shoulder of the control body. The mentioned radii are those of the respective seat faces of the control body.

In actuality, however, the angles of inclination between the faces are very small, for example, only a fraction of a degree. At actual calculation of the dislocations described, usual "sin" and "cos" function tables can not be used any more. Specific electric calculators are required for the actual calculation, because the "sin" and "cos" values appear at the sixth or seventh to eighth place behind the point after the zero.

Under these very stiff angles of inclinations between the faces described, the force with which the control body seat faces press into the seat faces of the housing multiplies extremely at lines 207 and 219 and may reach forces of tons even when the force on the arrow of FIG. 1 is actually only a few pounds. Under these forces the control body 1 sticks very hard between the lines 207 and 219 in FIG. 3.

This discovery of the sticking, as described, is the basic discovery of the present invention.

The further action of the invention is, to provide means, which prevent the rotation of the control body in the direction of the arrow in FIG. 1. When the rotation is prevented, the sticking of the control body is also prevented, because the sticking of the control body can actually appear only, when it revolves in the direction of the arrow of FIG. 1.

While the rotation of the control body is shown to be about 60 degrees in FIG. 3, because of the enlarged clearances 203 to 205, the actual angle of rotation until the sticking takes place, is only around one degree, less than one degree or a few degrees. In most actually built devices the sticking takes place, when the control body revolves about one half or two thirds of a degree. The angle of rotation until sticking occurs, depends on the size of the eccentricity and on the size of the radial clearances 203 to 205. The eccentricity is shown by "e" in FIG. 2. If the clearances 203 to 205 in FIG. 3 are actually 100 times smaller than they are drawn in FIG. 3, then the degrees of the pivotal movement (turn) would also be 100 times smaller, namely 60 degrees devided by 100=0.6 degrees at which the control body would bind. It should be noted that the control body does not weld in the seats of the housing but can be softened in the housing by a soft hammer blow in the direction opposed to the direction of the pivotal movement at which the control body bound.

Figure 4:
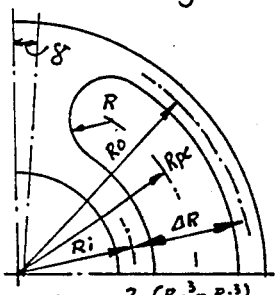
FIG. 4 explains the mathematical values of a control face.
Figure 5:
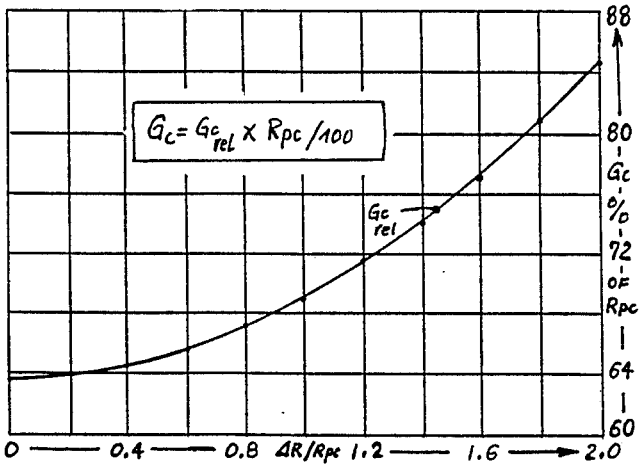
FIG. 5 gives a universally valid diagram for the pressure centers "Gc" of the control face of a control body.

Another discovery of the present invention is demonstrated in FIGS. 4 and 5. The calculation of the gravity center of a control face is given by exact equations in my mentioned patents. The calculation was, however, a matter of time consumption, because the equations were not simple and for every single control body the pressure center distance "Gc" from the axis of the rotor was to be calculated.

This present invention now discovers, that a generally useable diagram with a single curve can be developed, when the distance "Gc" of the pressure center of the control face from the axis of the rotor becomes written over the value of the relation:

$$\Delta R/Rpc.$$

I call this curve "Gc rel" and the formula for the simple calculation of the actual "Gc" value of the control body is given in FIG. 5. The curve for "Gc rel" is also given in FIG. 5. FIG. 4 gives the actual equation for a symmetric control face of 180 degrees halves, which is the basis for the novel curve "Gcrel" of FIG. 5. FIG. 4 also demonstrates the actual locations of the pressure field's outer radius Ro and the pressure field's inner radius Ri of the control face as well as the medial radius "Rpc" of the pressure field of the control face.

Thus, the actual value of "Gc" of each control face 2 of a control body 1 can now be simply found at hand of FIGS. 4 and 5 for every actual design of a control body.

Figure 7:
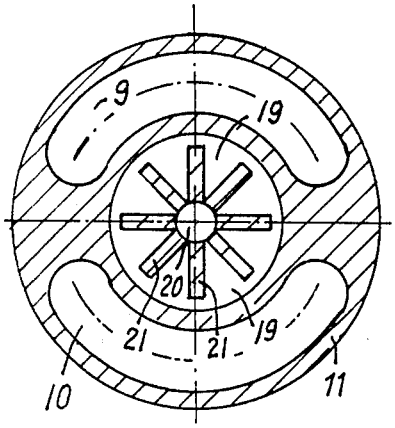
FIG. 7 is a cross-sectional view through FIG. 6 along the line VII—VII.
Figure 6:
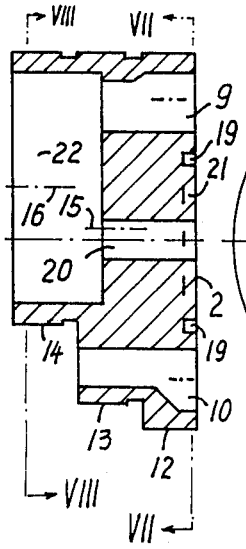
FIG. 6 is a longitudinal sectional view through an embodiment of a control body of the invention.
Figure 8:
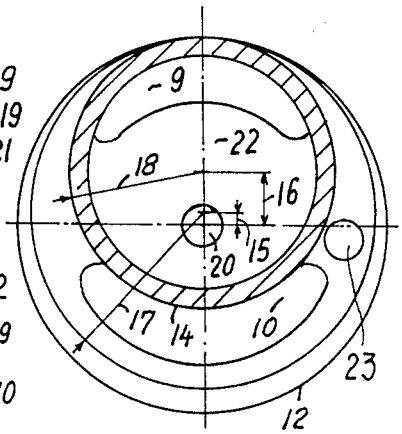
FIG. 8 is a cross-sectional view through FIG. 6 along the line VIII—VIII.

FIGS. 6 to 8 illustrate a most simple novel control body of the invention, wherein the control body 11 has only two seats 13 and 14. At least one of the seats is eccentric to the axis of the rotor, but actually often both seats are eccentric to the axis of the rotor. The Figures illustrate the first eccentricity 15 which forms with radius 17 the first seat 13 and a second eccentricity 16 which forms with radius 18 the second seat 14. Shown are also the control ports 9 and 10.

It was discribed in the opening part of this specification, that the Saalmann-Vetter Borowka reference can not have equalities of the pressure centers "Gc" and "gc" because the end of the control body 11 was subjected to a pressure chamber. Consequently, the control body of FIGS. 6 to 8 could also not have equal "Gc" and "gc" values and could therefore not properly function or work.

To prevent such unequalness of the "Gc" and "gc" centers, the present invention now disvcovers, that the equalness of the "Gc" and "gc" locations can be established very economically and with almost no costs, thereby, that a medial recess 19 becomes provided in the control face 2 and that it becomes communicated to the end of the control body, for example by a bore 20. Thereby a communication is established between the rear pressure thrust chamber on the rear end of the control body 11 and the medial recess 19. The medial recess 19 can be circular and centric for simplicity of machining. Support portions 21 may be applied in the medial recess 19 and form bearing faces in order to increase the bearing capacity of the control face 12 relative to the rotary face of the rotor.

The size of the medial recess 19 must be calculated and the pressure center of it must become incorporated in the actual "Gc" calculation of the control face 2. The pressure centers "gc" of the chambers behind the seat 14 and between seats 13 and 14 must be given such diameters and eccentricities 15 and 16, that their pressure centers "gci" and "gco" of chambers behind 13 and between 13 and 14 are with at least ninety percent of accuracy behind the pressure centers "Gci" and "Gco" of the control face. Meaning, that the distances "Gco" and "gco" as well as the distances "Gci" and "gci" from the axis of the rotor must be at least of ninety percent in accuracy with the equations of this patent application.

The embodiment of the invention of these Figures is not only most simple in machining, but it also prevents the pressure center unequalnesses of the mentioned Vetter Brorowka patent and it prevents the doubled leakage flows of the Creighton patent. It also is more simple in machining than the Creighton control body of his patent. Thus, the control body of this embodiment of the invention has also the feature of an increased reliability and economy of operation. A space 22 can be provided in the rear eccentric portion to make an assembly of respective parts of the motor or pump thereinto possible or to make the control body of reduced weight for application in airborne devices.

Also possible is, to set a recess or bore 23 for the reception of an arresting means, when the eccentricities 15 and 16 would be too small to prevent alone by themselves the rotation and sticking of the control body 11. The pressure chamber between the seats 13 and 14 is in practice often called "the outer chamber", while the pressure chamber rearwards of seat 14 is called "the inner chamber" because it lays radially inwards of the axial projection of the mentioned outer chamber. The control ports 9 and 10, however, are equally radially distanced from the concentric axis of the rotor. Therefore, there can not be an inner and an outer control port. Consequently, the control port 10, which is communicated to the outer chamber, is named "the first control port" while the control port 9, which is communicated to the mentioned inner chamber and to the medial recess 19, is named "the second control port". The pressure areas around the respective control ports are called "pressure zones" and they define in their centers the respective pressure centers "Gco" and "Gci" whereby the indices "o" and "i" define the relation and communication to the mentioned outer or inner chamber.

Figure 9:
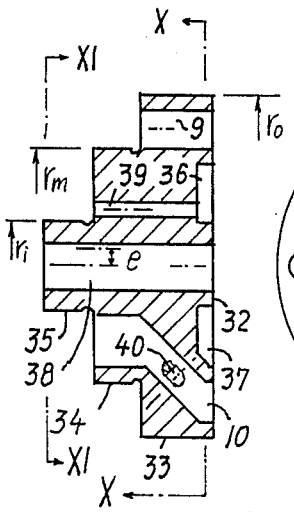
FIG. 9 is a longitudinal sectional view through an other embodiment of a control body of the invention.
Figure 10:
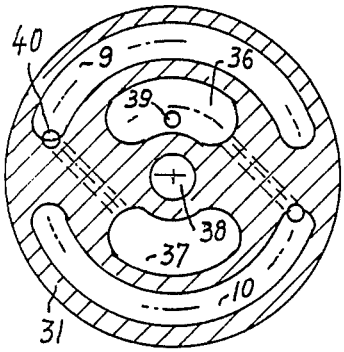
FIG. 10 is a cross-sectional view through FIG. 9 along the line X—X.
Figure 11:
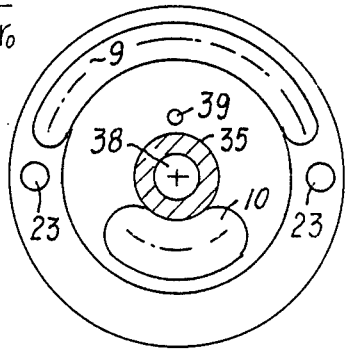
FIG. 11 is a view onto FIG. 9 from XI.

The next embodiment of the invention is demonstrated in FIGS. 9 to 11. The feature of this embodiment of a control body of the invention is, that all eccentric shoulders are spared. That makes the control body simple in machining and of little production costs, because all seats 33,34 and 35 of this control body are centric to the axis of the rotor. To make this possible for equalness of "Gc" and "gc" values, the control face 32 is provided with balancing recesses 36 and 37. These are so dimensioned, that they have equal "Gc" distances as the diametrically located control ports. For example the "Gc"-value of the 37 balance recess area is equal in size to the control port area 9 and the balance recess area area 36 is equal in its "Gc"-value to that of the control port area 10. But the "Gc" directions of the balancing recess areas are oppositionally directed to the "Gc" directions of the control port areas relatively to the axis of the rotor.

Balancing recess 36 is communicated for example by channel or bore 39 to the thrust chamber between seats 35 and 34. The balancing recess 37 is communicated by passage 40 to the thrust chamber between seats 33 and 34. The control port 9 extends into the thrust chamber between seats 33 and 34, while the control port 10 extends into the thrust chamber between seats 35 and 34. A medial recess 38 may be provided through or into the control body and may interrupt the medial portion of the control face 32 of control body 31.

When the seats are all centric, as described, there must be arresting provisions 23 provided in order to prevent rotation of the control body. These are in this case, however, simple matters, because the control body with all seats centric, can not stick as those with relatively to each other eccentric seats. The arresting means 23 can therefore be in this embodiment simple bores with pins engaging them with relatively large clearances and without an overly high degree of accuracy.

Instead of making all seats centric it is also possible to make them eccentric, when the ports 9–10 are radially large, for example. The balancing recesses 36 and 37 may then be narrower, bringing smaller "Gc"-values and thereby demanding eccentric seats partially for the equalization of the "Gc"- and "gc"-values. The bore 38 can then be provided in order to make it possible to extend a shaft through the control body 31 and thereby out of an end of the pump or motor wherein the control body is applied.

Figure 12:
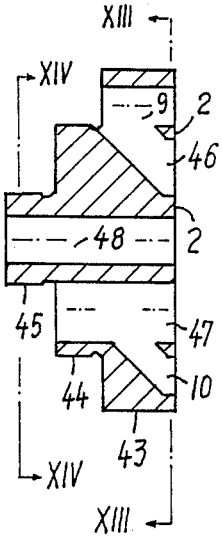
FIG. 12 is a longitudinal sectional view through a third embodiment of a control body of the invention.
Figure 13:
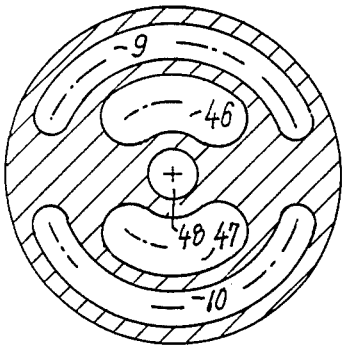
FIG. 13 is a cross-sectional view through FIG. 12 along the line XIII—XIII.
Figure 14:
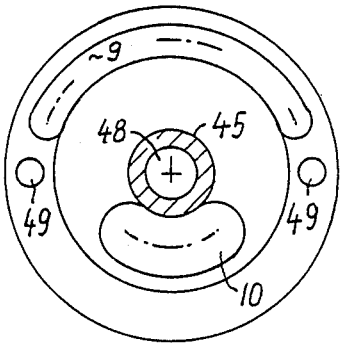
FIG. 14 is a cross-sectional view through FIG. 12 along the line XIV—XIV.

The other embodiment of the invention is demonstrated in FIGS. 12 to 14. It has the control ports 9 and 10 in control face 42 and may also have the medial bore 48. The specifity of this embodiment is, that the control body has second control ports 46 and 47. Control port 46 communicates to control port 9 and control port 47 is communicated to control port 10. Thereby it becomes possible to operate multiple chamber groups of a respective pump or motor. For example one working space group by control ports 9 and 10 and another by control ports 46 and 47. The consequence thereof however is, that the seat 44 must be eccentric and relatively large eccentric to the axis of the rotor. Whether the other seats 43 and 45 are centric or eccentric depends on the actuall "gc"-values, because the condition "Gc-s equal to gc-s" must be obeyed with at least 90 percent accuracy to the equations of this specification. Otherwise the control body would stick unless the rotation of the control body would be prevented by a very accurate arresting means 49. The actual measure-relation of a bore 48 in relation to the other measures may be different to the embodiment of FIGS. 9 to 10. Ports 9 and 46 are communicated to the thrust chamber between seats 43 and 44, while the control ports 10 and 47 are communicated to the thrust chamber between seats 44 and 45.

Regarding the embodiment of FIGS. 6 to 9 it should be recognized, that the area of the control face which is connected to control port 9 is bigger in cross-sectional area than that which is connected to control port 10. Consequently, the thrust chamber between seats 13 and 14 has a smaller cross-sectional area than the thrust chamber behind seat 14. It is thereby an important and novel characteristic of the embodiment of FIGS. 6 to 9 of the invention, that the circular thrust chamber behind seat 14 has a bigger cross-sectional area, than the sickel-shaped thrust chamber between seats 13 and 14.

To "stick" or to "bind" are terms used to define that the ability to move is lost.

Figure 15:
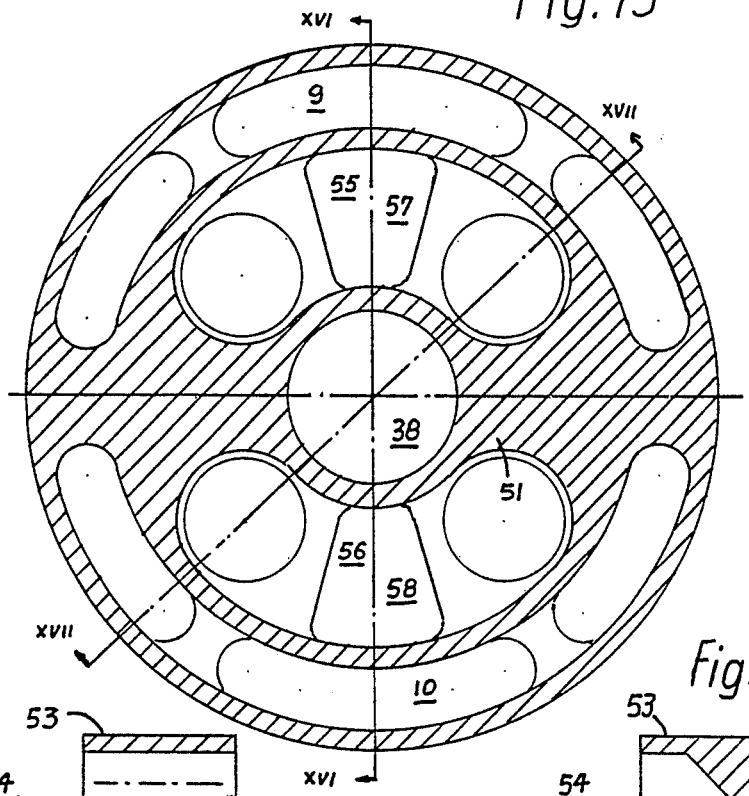
FIG. 15 is a cross-sectional view through a control face portion of a fourth embodiment of a control body of the invention.
Figure 16:
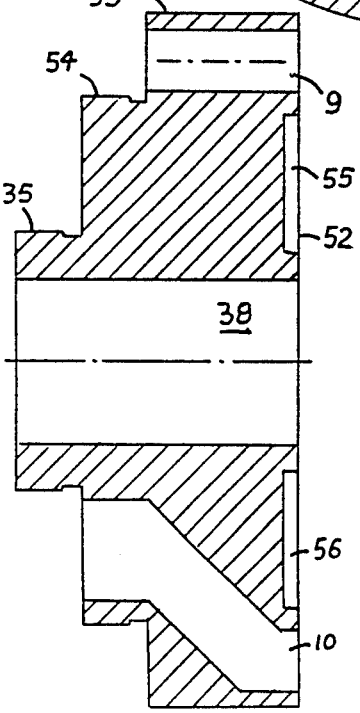
FIG. 16 is a sectional view through FIG. 15 along the line XVI—XVI.
Figure 17:
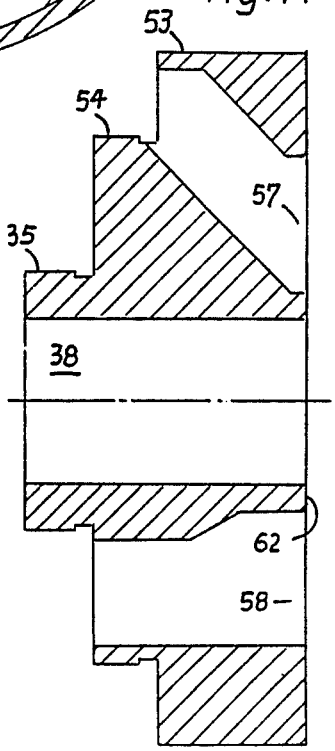
FIG. 17 is a sectional view through FIG. 15 along the line XVII—XVII.

In the embodiments of FIGS. 15 to 17 several possibilities of communications to chambers are shown. And also demonstrated is, that recesses 57 and 58 might be utilized as control ports or as balancing recesses upon desire.

The arrangements of these Figures are basically similar to FIGS. 9 to 11, but FIGS. 15 to 17 are drawn in a larger scale. And further additional possibilities are demonstrated. FIG. 15 shows the ports 9 and 10 as well as the recesses 55,57,58,56. The lines in ports 9 and 10 demonstrate, that there can be ribs in the ports for the obtainment of radial strength. The lines in recesses 55,56,57,58 in FIG. 15 however shall demonstrate, that there could be different communication channels, such as in FIG. 16 or as in FIG. 17 or also as in some of the later Figures.

FIG. 16 shows, that control port 9 extends into the thrust chamber between seats 53 and 54. The Figure also shows, that control port 10 can obtain a passage of considerable cross-sectional area to extend into the thrust chamber provided between seats 35 and 54. The recesses 55 and 56 in FIG. 16 are balancing recesses similar to those of FIGS. 9 to 11 and they can be respectively communicated by channels which are not shown in FIG. 16. For example recess 55 communicates with the chamber between seats 35 and 54. Recess 56 communicates with the thrust chamber between seats 53 and 54.

What FIG. 17 separatedly demonstrates, is, that the recesses 55,56 of FIG. 16 can be used as control ports, when they are provided with passages of suitable cross-sectional area as shown in FIG. 17. Control port 57 extends then to the thrust chamber between seats 53 and 54. Control port 58 extends then into the thrust chamber between seats 35 and 54. Thus, the control face 62 has inner and outer recesses 9,10,55,56 or 57,58 whereof the latter can be used or built as control ports as in FIG. 17. The connection to the thrust chambers could also be vice versa, if so desired.

Figure 24:
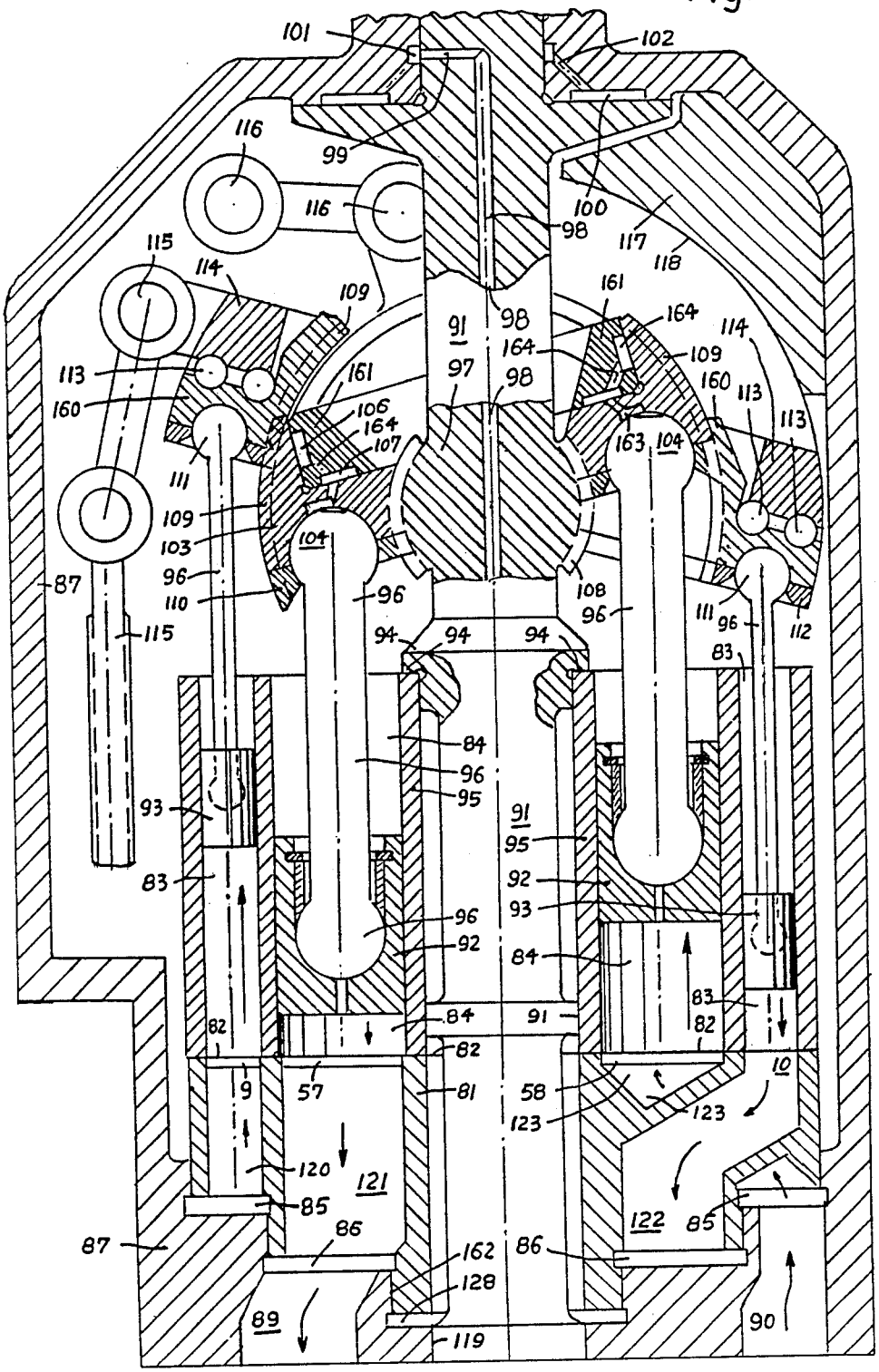
FIG. 24 is a longitudinal sectional view through an axial piston device of the invention.
Figure 25:
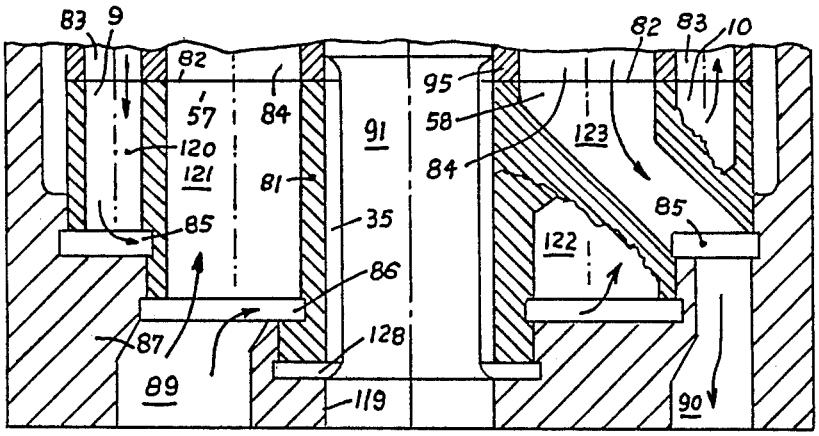

FIG. 15 in combination with FIGS. 16 and 17 shall also demonstrate, that the control body could have control ports 9 and diametric control port 58 be communicated to the thrust chamber between seats 53 and 54. And control port 10 with the diametric control port 57 to the thrust chamber between seats 35 and 54. Or the passages could be set vice versa. The actual communication of this kind is however not shown in FIGS. 16 and 17, but will be understood when FIGS. 24 and 25 are viewed regarding the passages through the control body. For example the control body of FIG. 24 shows a passage from control port 10 into the chamber between seats 35 and 54. It also shows a passage from port 57 to the thrust chamber between seats 35 and 54. And FIG. 25 shows in its control body a passage from port 58 to the thrust chamber between seats 53 and 54, when the respective passages would be provided in the control body of FIGS. 15 to 17.

The central bore 38 and seat 35 serve principially the same purposes as in FIGS. 9 to 11.

FIGS. 15 to 16 are drawn in an actual scale, where the "Gc"-values of the inner outcuts 55,56 or 57,58 are equal to the "Gc"-values of the outer recesses or control ports 9 and 10. But the "Gc"-values of the inner chambers are diametrically oppositionally directed respective to the outer recesses or outcuts. Thereby the sum of the respective co-operating and co-communicated recesses, ports and chambers are summarizing up to zero and so do the "gc"-values of the thrust chambers. The reduction of the scale of the drawing in the expected patent will not very drastically change the relationship of the values discussed.

When the relative radial extensions and locations are changed, the summarization of the "Gc"-values may change and an eccentricity may then be needed for one or more of the seats 35,54 and/or 53. Thus, the use of the control body and of the communications therethrough depends largely on the actual desire, whereby however, the rules for equalness of "Gc"- and "gc"-values must be obeyed. When centric thrust chambers are used, the arrester against rotation must be set, as explained at hand of FIGS. 9 to 11. The arresting means is however not shown in FIGS. 15 to 17, because it is already understood from FIGS. 9 to 11.

Figure 18:
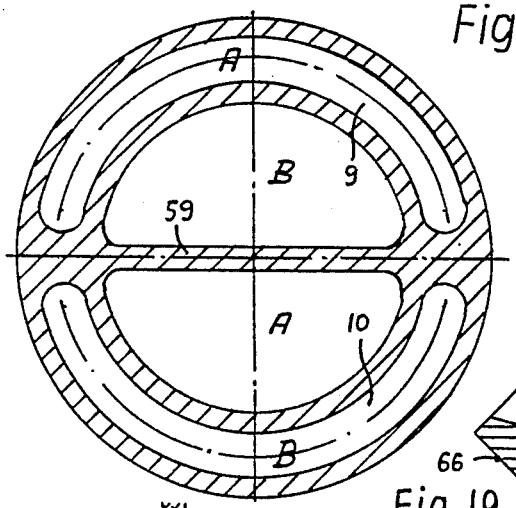
FIG. 18 is a cross-sectional view through a control face portion of a fourth embodiment of a control body of the invention.

FIG. 18 demonstrates, that an optimum of cross-sectional area of control ports can be obtained, by eliminating the medial bore 38 and separating the inner recesses or outcuts or ports from each other by a narrow sealing land 59. The condition "gc=Gc" must be obeyed again. The communication of the inner and outer recesses or ports must be done crosswise, as in the other Figures of similar relation. Thus, spaces with "A" must communicate together and spaces defined by "B" must communicate together in FIG. 18. Spaces with sign A must be communicated to one of the chambers and those with "B" to the other of the thrust chambers on the rear portion of the control body. The Figure is drawn as a sectional view parallel to the control face of the control body.

Figure 20:
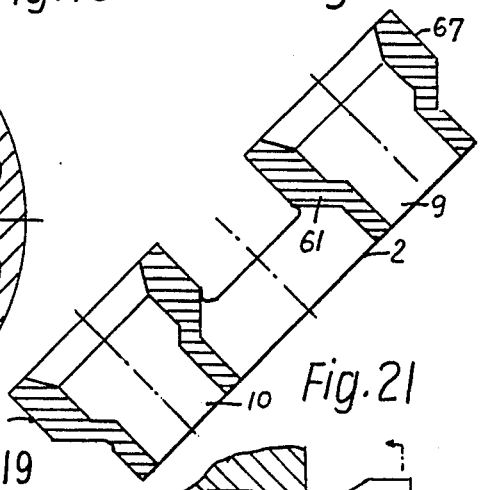
FIG. 20 is a sectional view through FIG. 19 along the arrowed line in FIG. 19.
Figure 21:
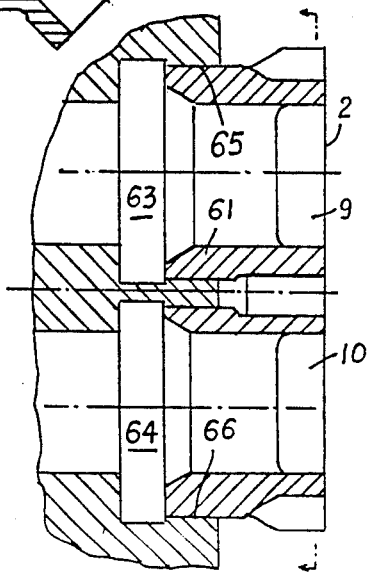
FIG. 21 is a sectional view through FIG. 19 along the arrowed line XXI—XXI.
Figure 19:
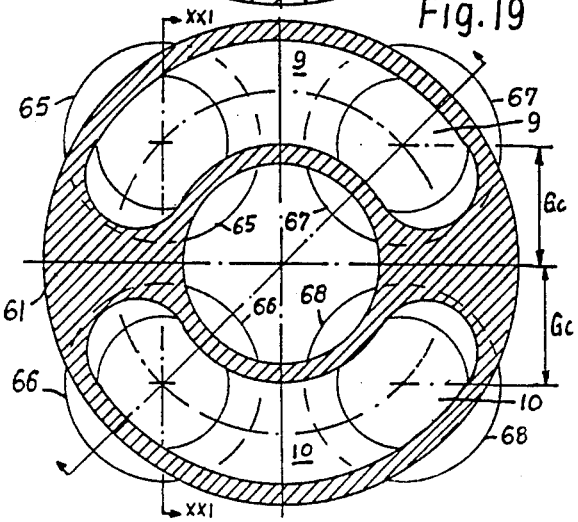
FIG. 19 is a cross-sectional view through a control face portion of a fifth embodiment of a control body of the invention.

The embodiment of the invention which is demonstrated in FIGS. 19 to 21 has four circular shoulders with seats 65 to 68 on control body 61. Each circular seat 65 to 68 is formed with an equal radius around a center, whereby the centre of each seat is located in the pressure center "Gc" of the control face of the control body. Thereby the center—axes of the seats 65 to 68 are located eccentrically of the axis of the rotor. While there are four such seats, there can be any desired multiples of two seats provided with in each case two diametrically relatively to the axis of the rotor located seats are forming a seat pair of opposite or different pressure. The provision of four seats 65 to 68 as shown in the Figures is however the most practical one, because thereby a most compact design is obtained which can easily be used to extend into central outcuts of the respective rotor. The Figures are shown in a scale of true relationships, where the "Gc"- and "gc"-values are equal and the thrust chambers 63,64 etc. of the seats 65 to 68 are suitably dimensioned to force the control body 61 strongly enough but not too strong against the rotary face of the respective rotor. Each seat or shoulder 65 to 68 extends into a respective thrust chamber like 63 or 64 in FIG. 21 in the housing portion 60 of the device. It should be noted, that the control ports 9 and 10 do not extend straightly through the control body 61 but only into it and they are closed towards the rear end of the control body 61 with the exception of passages which extend into and through the respective seats 65 and 68.

Control port 9 thus extends into its twin seats 65 and 67 of the respective shoulders 65 and 67 which extend into the respective thrust chamber and seal therein by seats 65 and 67. Control port 10 extends into its twin shoulders and seats 66 and 68. These shoulders 66 and 68 are again extended into a respective thrust chamber in housing portion 60 and are sealed therein by seats 66 and 68.

It is seen from the Figures, that the thrust chambers are simple cylinders with inner faces and the shoulders are simple cylinders with outer faces fitting into the inner faces of the thrust chambers by their seats 65 to 68. These provisons can be simply machined and the assembly prevents itself from rotation. The arrangement can not stick. The provision of a plurality, but preferredly of a pair of such seats 65 to 68 to a single control port as done by this embodiment of the invention, provides a clear equalness of the "gc"- and "Gc"-values and it gives a comfortable design of compactness and small radial extension, wherein the seats 65 to 68 only very slightly extend over the outer diameter of the control face.

Figure 22:
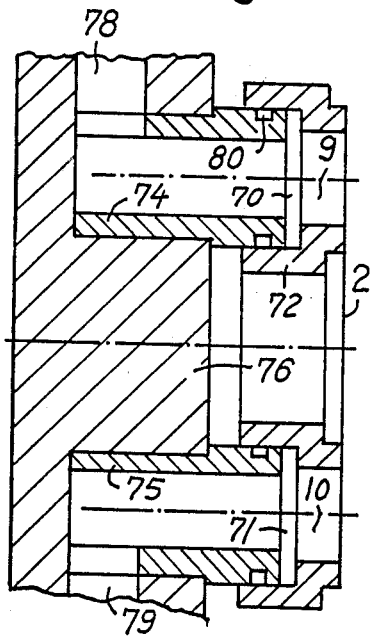
FIG. 22 is a longitudinal view through the sixth embodiment of a control body.

A different style of production of the control body arrangement of FIGS. 19 to 21 becomes possible by FIGS. 22 and, or, 23. These Figures demonstrate, that, instead of making the shoulders 65 to 68 integral with the control body 61 it would also be possible to machine bores 70 to 71 into control body 72. The bores 70 to 71 which may be a plurality thereof, for example four such bores, end into the respective control port 9 or 10. Axially aligned with the respective bores are then pipe portions 74, 75 equal in number to the number of bores 70,71. These pipe portions are extending into the bores 70 to 71 and are sealing therein. They are fastened in the Figures in the respective housing portion 76 or 77. The pipes thereby seal the bores 70 to 71 and they are also keeping the control body 72 or 73 in its proper position and prevent it from rotation. The axes of pipes and bores 70,71,74,75 are again located in the pressure center "Gc" of the control face 2. So, as in FIGS. 19 to 21. Passages 78 and 79 are the exit- and entrance-passages of the device and are located as in the other Figures in the respective housing portion 76 or 77.

Figure 23:
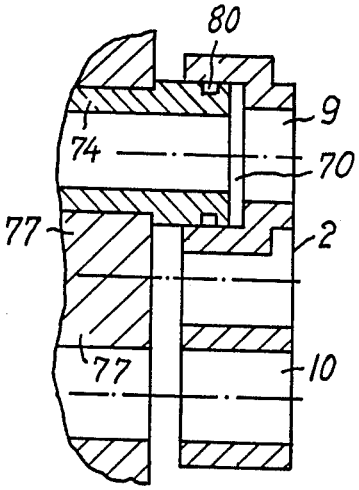
FIG. 23 is a longitudinal sectional view through the seventh embodiment of a control body of the invention.

When the control body 73 of FIG. 23 is used only for a single direction of flow, the low pressure area of control port 10 may not need a sealed passage of flow, when fluid is permitted in the interior space of the motor or pump, wherein the arrangement of FIG. 23 is applied. It is then satisfactory to set only two bores 70 or a plurality of bores 70 and of holding pipes 74. They will keep the control body 73 in its proper place, will prevent it from rotation, will exclude sticking and dislocation, will passe the high pressure fluid to or from the working spaces in the rotor and seal the passage of high pressure fluid effectively. They will also provide the proper thrust in the direction towards the rotor and will obey the rule: "gc equal to Gc". In this figure as well as in all the other Figures the control body must be axially moveable to complete the thrust against the rotary face of the rotor. Seal seats for plastic seals, like O-rings, may be provided in the respective shoulders or pipe portions of the figures. They are shown in the Figure by referentials 80.

The control body 81 in FIG. 24 demonstrates the possibility to control a plurality of fluid flows through a device and to let the flows flow in opposite directions on the respective half or substantial half of the machine.

Rotor 95 is revolvably borne in housing 87. The bearing of the rotor 95 is done by medial shaft 91 and its shoulder 94. The rotor 95 seats on radial seats of shaft 91 and the front face of the rotor 95 is partially embraced by shoulder 94 of shaft 91. Shaft 91 is borne in the rear bearing seat 119 of shaft 91 and of housing 87 and it is borne in the front of housing 87 by radial bearing means 101 whereof the shaft itself may constitute a bearing portion as it may also do in rear bearing 119. A thrust bearing 100 is formed for example in the front portion of housing 87 to carry thereon the axial thrust of shaft 9. The shoulder 94 of shaft 91 then carries the axial thrust in forward direction, which might be excerted onto the rotor 95. Bearing 100 and/or 101 may be fluid bearings and may be supplied with fluid under pressure through passage 98 in shaft 91 and through communication passages 99. Respective fluid under pressure may be led into passage 98 by a respective pressure source or by communication to a respective thrust chamber 85 or 86.

The radial cross-sectional areas of thrust chambers 85 and 86 behind control body 81 are slightly—for example by factor "fb"—larger than the cross-sectional areas of the respective pressure zones along control face 82 on the front end of control body 81. Thereby control body 81 is pressed against the rotor 95 in forward direction, whereby the control face 82 touches the rear end face of rotor 95, seals therealong and presses rotor 95 forward against the shoulder 94 of shaft 91 and thereby shaft 91 against the front—axial bearing 100. Axial bearing 100 carries the mentioned and applied axial load of thrust chambers 85 or 86 respectively; however minus the load of the pistons 92 and 93 in the cylinders 83 and 84 of rotor 95. Because, the axial load of pistons 93 is borne over connecting rods 96, the rotary seat plate 160, thrust bearings 113 and inclineable plate 114 the axial load of pistons 92 is borne over connecting rods 96, rotary seat plate 103, bearings 106, 107 and inclineable plate 161. Thus, the load of fluid pressure in the cylinders 83, 84 is not carried by medial shaft 91.

The embodiment of the invention of this Figure has a plurality of working chamber groups in rotor 95. The drawing is set into such condition, that the different working space groups 83, 84 are operating in opposite directions in the same substantial half of the control zone. One working space or cylinder group is represented by referentials 83 and the other by referentials 84. When fluid flows along the arrows on the left half of the drawing into cylinders 83 it flows out in the opposite direction out of cylinders 84 on the left side of the drawing. Fluid flows then into cylinders 84 on the right side of the drawing and out of cylinders 83 on the right side of the drawing, as the arrows indicate. The directions of flows can be reversed, as it is illustrated in FIG. 25.

FIG. 25 is just the bottom portion of FIG. 24, however, with the other passage connection of control body 81.

In FIG. 24 at the situation as drawn, fluid enters through connection or entrance port 90 into the outer thrust chamber 85. From there the fluid flows through thrust chamber 85 into passages 123 and 120 of control body 81 and through control ports 9 and 58 of control body 81 into cylinders 83 and 84 of rotor 95. The fluid leaves the cylinders 83 and 84 through control ports 10 and 57 of control body 81 and flows then through passages 121 and 122 of control body 81 into and through the inner thrust chamber 86 and out from there through connection port or exit port 89.

The reversed direction of the flows is shown in FIG. 25. There port 89 serves as entrance port and port 90 serves as exit port. The fluid flows through entrance port 89, inner thrust chamber 86, passages 121, 122; control ports 10, 57 into the respective cylinders of cylinder groups 83 and 84 and out thereof through control ports 9, 58, passages 120, 123, outer chamber 85 to and out of now exit ports 90.

The reversal of the direction of the flows may become effected either by counter—rotational direction of rotor 95 or by opposite inclinations of the inclineable control discs or control plates 114, 161.

The radial sizes of control face 82, rotor 95, cylinders 83 and 84 as well as that of the medial outcut in rotor 95 and in control face 82 and control body 81 are drawn in a proper scale, at which the chamber groups 83 and 84 are forming in the respective pressure zones of the control face 82 and around control ports 9, 57, 68, 10 equal cross-sectional pressure areas on opposite sides of the axis of rotor 95, shaft 91 and control face 82 and control body 81. Consequentely the thrust chambers 85 and 86 on the respective rear portions of control body 81 are provided with equal cross-sectional areas. The rear seat 162 restricts the inner thrust chamber 86 radially inwardly.

At those actual designs of the invention, where the pressure centers "Gc" are equally but diametrically oppositionally distanced from the said axis of the rotor, the thrust chambers 85 and 86 are centrically located relatively to each other and also to the axis of the rotor. Where the sum of the "Gc"-values is not zero, the thrust chambers 85 and/or 86 are provided eccentrically either one of them or both and relatively to the axis of the rotor or also to each other.

Equal cross-sectional areas of the double control port pair system of the here discussed Figures are possible as long as the radial distance through the radially outer pressure zone remains smaller than one third of the medial radius of the outer pressure zone. Or, in other words, "delta R/Rpci" of the outer zone must remain smaller than 0.33.

Instead of having one flow of fluid flowing through the plural working cylinder groups of FIG. 24 it is also possible to let two separated flows of fluid flow through it. That is demonstrated by way of an example of a respective embodiment in FIG. 26. The rear portion of the device, which may be a radial or axial piston device, pump or motor, has four separated thrust chambers and four separated passages through the respective control body 131. One separated flow flows through cylinder group 83 and the other separated flow flows through cylinder group 84. When the "gc"-values of the thrust chambers are equal to the respective "Gc"-values of the control face 132, the pressures in the plural flows can be different.

The outer cylinder group flow flows from entrance port 137 through thrust chamber 133, passage 146, control port 9 into the respective intaking cylinders 83 of group 83 and leaves the respective discharging cylinders 83 of group 83 through control port 10, passage 148, thrust chamber 134 and exit port 140.

Figure 26:
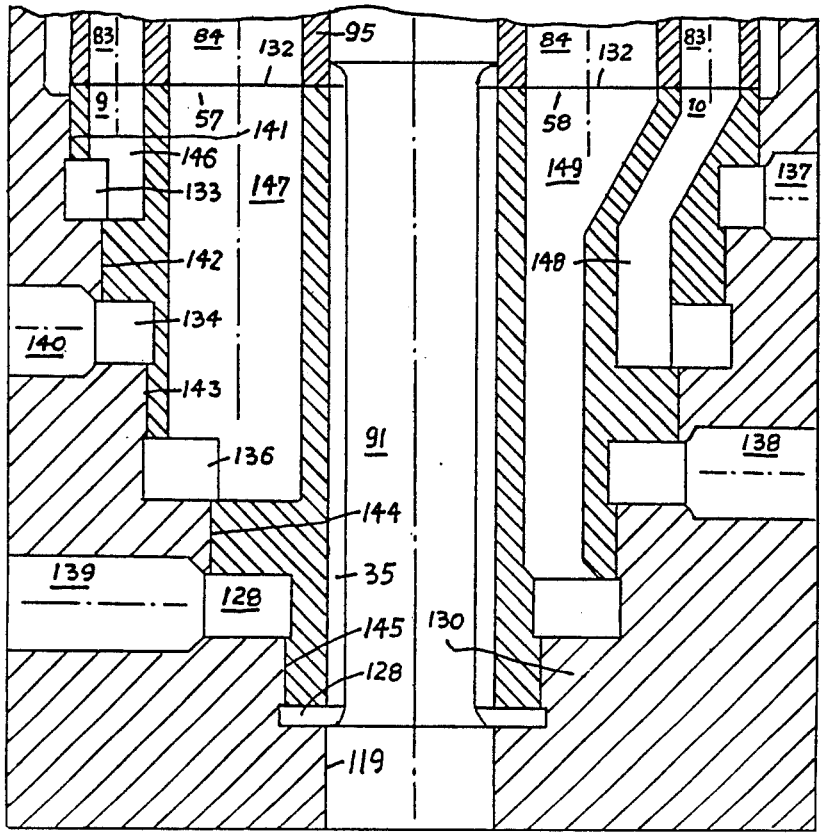
FIG. 26 is an alternative of a control body to FIG. 24 and thereby a longitudinal sectional view through the eighth embodiment of a control body of the invention.

The inner cylinder group flow flows from entrance port 139 through thrust chamber 136, passage 149, control port 58 into the respective intaking cylinders 84 of cylinder group 84 and leave the respective expelling cylinders 84 of cylinder group 84 through control port 57, passage 147, thrust chamber 135 and exit port 138. The directions of the flows may be reversed. Instead of extending the entrance and exit ports to right and left as shown in FIG. 26, the may extend in oppositional direction, axially or in an inclined direction.

When the "gc"-values are equal to the "Gc"-values in all control-zones and thrust chambers, the directions of the flows are unristricted. That means, that both flows can then be independently controlled and reversed.

The control body 131 forms respective shoulders and seats. For example, as FIG. 26 shows, the front seat 141; the seat 142 between thrust chambers 133 and 134; seat 143 between thrust chambers 134 and 135; seat 144 between thrust chambers 135 and 136 and the rear seat 145. The rear chamber 128 is commonly communicated to a space under no or under low pressure.

The seats have to seal the respective thrust chambers and they must be located and dimensioned with at least 90 percent of accuracy relatively to the equations of this patent application.

FIG. 24 also demonstrates by example, how the control of the delivery quantity of the plural flows can be controlled. The heads 104 of connecting rods 96 are borne in seats of the rotary seat plate 103. The heads 111 of connecting rods 96 are borne in the other rotary seat plate 160 . The mentioned connecting rod heads may be kept in the respective seats by holding means or holding plates 110 and 112 respectively. The inner heads of the connecting rods are set into the pistons 92 or 93 respectively.

Rotary seat plate 103 is driven by shaft 91 and rotary seat plate 160 is driven by rotary seat plate 103. For that purpose spherical gears or splains 108 are formed between shaft portion 97 and the inner rotary seat plate 103. Respective sphaerical gear or splain means 109 are formed between the inner rotary plate 103 and the outer rotary seat plate 160. Thereby the shaft 91, the rotor 95, the inner rotary seat plate 103 and the outer rotary seat plate 160 are revolved in unison.

The inner rotary seat plate 103 is borne in axial thrust- and radial bearing 107–106 of the inner inclineable adjustment plate 161. The bearing may be a mechanical bearing or, as shown in the Figure, a hydrostatic bearing with sealed fluid pressure pockets 106, 107. Fluid under pressure may be led into pockets 106, 107 out from the respective cylinders 83 through bores in the connecting rods 96 and through respective passages 163, 164 in parts 103 and 161. Bearing 107 may be an axial thrust bearing, while bearing 106 may be a radial bearing. They could become replaced by a single bearing, when set normal to the direction of thrusts of the connecting rods 96.

The outer rotary seat plate 160 is radially and axially borne in mechanical bearings 113 on the outer inclineable adjustment plate 114.

The inner and outer adjustment plates 114 and 161 may have a common controller for adjustment of their inclination. For example an oppositionally acting common controller for opposite increase or decrease of the inclination of the plates 114 and 161. The common controller could also adjust them in equal inclination direction, if so desired. In such case, the plates 114 and 161 may also be replaced by a common single inclination adjustment plate.

In FIG. 24 it is however indicated, that there also could be independend controllers 116 and 115 be provided to the respective inclination adjustment plates 114 and 161. Supports 117 with spherical inner guide and bearing faces 118 might become provided behind the respective inclination adjustment plates 114, 161, when so desired.

The degrees of inclinations of the plates 160 and 114 or 103 and 161 define the stroke of the pistons 92 and 93 and thereby the quantity of the flows through the device.

Figure 27:
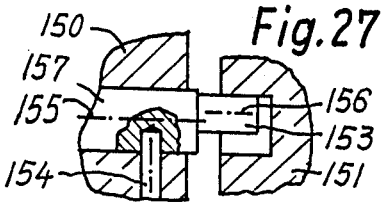
FIG. 27 is a longitudinal sectional view through a preferred embodiment of an arresting means of the invention.

FIG. 27 shows a preferred example of an arresting means to prevent rotation of a control body, which would otherwise stick, as described in this patent application.

The respective control body 151 is provided with a recess 152, which might be a recess 23 of FIGS. 6 to 11. In the housing portion 150 a pin 157 is inserted. Pin 157 has a centric portion with axis 155 and an eccentric front portion 153 of a smaller diameter around eccentric axis 156. The front portion 153 is engaged into recess 152 in control body 151. To prevent the rotation of control body 151, which would lead to the described sticking of the control body, the pin 157 is revolved in housing 150 until the outer wall of the eccentric portion 153 touches against the respective portion of the inner wall of recess 152. When this touching is properly reached, the arresting pin 157 is blocked from further rotation by a stopper pin 154 in housing 150, which enters into arresting pin 157 and keeps it in the set position.

The eccentric portion 153 is provided on arresting pin 157, because the accuracy of setting of control body 151 is very high. The restriction of the rotation of control body 151 should be less than one degree. In such case a common drill of a bore into the control body might not accurately enough have the same axis as the bore of the setting of the pin into the housing. The application of the eccentric portion on arresting pin 157 and the revolving of pin 157 and its fixing by stopper pin 154 serves to asure the proper arresting of the control body by the adjustment of slightly unequal axes by the rotation of the eccentric portion 153 in the slightly wider recess or bore 152 in control body 151.

The mathematical equations, which must be obeyed in this patent application and which are known from my mentioned earlier patents, are:

$$A_{HPmb} = (Ro^2 - Ri^2)\pi G fb \tag{1}$$

with:

$A_{HPmb}$=cross-sectional area of the thrust chamber;

Ro=outer radius of pressure zone around control port;

Ri=inner radius of pressure zone around control port.

See hereto FIG. 4 and use the radii of the high-pressure equivalent zones.

G=(180+2 gamma)/360. See hereto FIG. 4.

For high speed devices gamma becomes zero, because gamma appears gradually changing between minus and plus, when a rotor passage runs over the closing arc of the control body. Thus, in most cases, Gamma sums up to zero and G becomes 0.50.

fb=Balancing factor. It is commonly 1.02 to 1.08 and defines which which force the thrust chamber shall press the control body against the end face of the rotor or against the rotary slide face.

$$Gc = \tfrac{2}{3}\,\frac{(Ro^3 - Ri^3)}{(Ro^2 - Ri^2)} \times fG \tag{2}$$

wherein the "R" values are explained above and seen in FIG. 4. fG becomses 0.6369 when gamma is zero (symmetric, 180 degree control face). Otherwise $$fG = \frac{\sin \alpha_2 - \sin \alpha_1}{\alpha_2 - \alpha_1}$$

with $\alpha$ in arch values.

And:

$$gc = \int \frac{\pi\theta}{s40}\left[\left(ro - \frac{e^2}{4ro} + \frac{e\sin\alpha}{\text{arc}\theta} - \frac{e\sin(\alpha-\theta)}{\text{arc}\theta} + \frac{e^2\sin 2\alpha}{8ro\text{arc}\theta} - \frac{e^2\sin 2(\alpha-\theta)}{8ro\text{arc}\theta}\right)^3 - K^3\right]\log\left(\alpha - \frac{\theta}{2}\right) d\alpha/Ki^{-} \quad (3)$$

which is: $gc = \int Ba/Ki^{-}$ ;

wherein the "r"-values are the outer and inner seat-radii of the respective thrust chambers and "$\theta$" is an angular intervall of calculation. A good formular for calculation of the pressure center "gc" of the respective thrust chamber at hand of the above equation (3) is given for example in my japanese patent application publication No. 92 604 of 1974 or my German Pat. No. 23 00 639. "e" is the eccentricity of the shoulder. See FIG. 9.

At the present time it is however more convenient to spare the time of calculation in the formulars, which requires about 4 hours, to find one "gc"-value with an electric pocket calculator. It is therefore now recommended to use a small programmable calculator, for example Casio FX-502 P. This little computer is nowadays available for about a hundred dollars.

With the following symbols: M=Memory in and R=memory recalled with the diget thereafter the number of the memory, the casio can be programmed in mode 2 as follows:

```
HLT,MIN, 1, R3,−,R2,×,R14,%,R3,=,+,R2,×,(,R1,+,5,),sin,%,R11,=,
−,R2,×,(,R1,−,5,),sin,%,R11,=,+,R2,×,R2,×,(,(,R1,+,5,),sin,%,(,R3,
×,R12,),=,−,R2,×,R2,×,(,(,R1,−,5,),×,2,),sin,%,(,R3,×,R12,),=,
Inv x^y,3,=,−,R4,Inv x^y,3,=,×,R13,=,×,(,R1,cos,),=,HLT,
R9,%,R5,=,HLT,RF,×,R3,×,R3,−,RF,×,R4,×,R4,=,HLT,%,R10,=,HLT.
```

(4)

When the above program was typed in the Writing mode 2=WRT into for example programm Po, the calculator has to be returned to the operation mode 1=RUN.

The following constants have to be put into the following memories:

| | |
|---|---|
| arc $\theta$ = o,174 into M11; | 8 arc $\theta$ = 1,392 into M12; |
| Piγ $\theta$/540 = 0,0582 into M13; | 1/4 = o,25 into M14; |
| 17,4 into M5; | 36 into M10; and 3,1416 into MF. |

Therein the value "17.4" is an improvement over the earlier used "18" and nears a more perfect solution, because the radius runs not excactly through the medial intervall "$\theta$".

With the above programm, developed by the inventor, there are remaining only thre variables, namely: "e", ro, and ri or rm.

They are to be typed into the following memories: "e" into M2; "ro" into M3, and: "rm" into M4; or: "e" into M2; "rm" into M3; and: "ri" into M4.

The computer is now programmed to calculate the Ba values of intervalls of 10 degrees $\theta$.

Operate the calculation as follows: calculate the intervalls with alpha=0, 10, 20, 30, 40, 50, 60, 70, 80, 100, 110, 120, 130, 140, 150, 160, 170, and 180.

By typing: Ac, Po, alpha Min1, Exe.

Use "0" as the first alpha. Memorize, that the "Ba" values of alpha "0" and "180" must be halved, before becoming memorized in memory M9. The others are not to be halved.

After the "0" was used for alpha and Ac, Po, 0, Min 1, Exe was typed, the computer uses about 25 seconds to calculate the "Ba-Value" of alpha=zero. Type, after the result has appeared, type: %, 2,=; to half the result.

Type the result into memory 9 by typing: Min 9.

Continue the calculation by using the next alpha, which is: 10.

Type: Ac, Po, 10, Min 1, Exe. When result came, type: +,R9,=,Min,9. The first two results have now been summarized in memory 9. Continue the next value of alpha.

Type: Ac, Po, 20, Min, 1, Exe, — wait, type: +,R9,=,Min,9.

After the last result, that of 180 alpha, has appeared and was halfed as it was done by alpha zero, continue to type: EXE and the sum of the "Ba" values appears, Note it down.

Type again: EXE and the integral medial value of "Ba" appears. Note it down.

Type again: EXE and the cross-sectional area of the thrust chamber appears. Note it down.

Type again: Exe and the integral value of K1 appears. Note it down.

Thereafter divide by normal calculation the value of medial Ba through K1. The values are between the last four noted results. The result of this final calculation is: "gc" or "gc+e".

By the above proposed calculation methode, the time of calculating one "gc" pressure center of a thrust chamber reduces from approximately four hours to less than ten minutes.

When the "gc-value" is not equal to the "Gc-value", try a number of other eccentricities "e" until a diagramm can be written with "gc" over "e" and the "e"-place be found, where "gc" would be allright. Re-calculate the so found "e"-value to be sure, that the "gc"-value is now correct.

That the thrust chambers can be made circular by summarizing the "Gc"-values of the control face to zero, can not in all dimensions be done. Often in praxis, a rather large cross-sectional area of the passages and ports is desired. In those cases it is not all times possible to summarize the "Gc"-values of the control face to zero and then at least one of the thrust chambers must become placed eccentrically with "gc=Gc". Thereby the "gc"-values are becoming often very small and that results then in small eccentricities "e", which proves how important the arresting of the control body of the invention can become.

For two thrust chambers, whereof one is located on the end of the control body and is circular, the other surrounds is as sickel-shaped with one point of the circles meeting, which means, that the maximally possible eccentricity "e" is applied and, when both chambers are of equal cross-sectional area, the following linear values apply, whereby sometimes calculations of sophisticated nature can be spared:

$$di = 2ri = \sqrt{A_{HPmb} \times 4/\pi}$$

$$do = 2ro = 7.4142\ di;\ ro = 7.4142\ ri$$
$$= 0.5\ (do - di) = ro - ri$$

$W$ = distance between the pressure centers of the two thrust chambers.

$= W = 2gc = 7.95$ to $2.09\ e_{max}$.

What this present patent application considers to be known in the former art, is:

A control arrangement in a device which takes in and expells fluid through passages and ports and through working spaces located in a rotor which is revolvably borne in a housing, at least one rotary slide face is formend on a portion of the rotor, at least one pressurized fluid containing thrust chamber formed in a portion of the housing and communicated to at least one of the passages, a control body inserted at least partially into the thrust-chamber with a rear shoulder towards the interior of the thrust chamber and forming a non-rotary control face on the front end of the control body which is interrupted by control ports to control the flow of the fluid to and from the working spaces and through the rotary slide face while the pressurized fluid in the respective thrust chamber presses the control body towards the rotor to seal with the control face along the rotary slide face when the rotary slide face slides and revolves over the control face of the control body, wherein the respective thrust chamber forms a pressure centre axially behind the respective pressure center of the respective control portion of the control face;

and what is considered to be one of the basic provisions of the invention, is, that means are provided on the control body to prevent sticking of the control body under forces appearing along the control face during slide of the rotary slide face over the control face;

while details of the provisions of the invention are, for example demonstrated as follows:

that said means is a relationship between the pressure center "gc" of the respective thrust chamber, the eccentricity "e" of an eccentric shoulder of said control body, a low balance factor "fb" for slightness of higher thrust in said chamber compared to the oppositionally directed thrust along said control face and an accuracy of at least ninety percent of the said pressure center "gc" and the pressure center "Gc" of the respective control face portion, whereby said rotation and sticking of said control body is prevented by the thereby obtained minimizing of friction on said control face and said eccentricity is able to maintain the proper alignement of said control body to prevent it from rotation within its seats and thereby to eliminate the sticking of the control body by clamping together of faces under extremely small angles of relative inclination.

Or, as explained at hand of FIGS. 6 to 11;

that said means is at least one arresting pin in at least one arresting recess, one of said pin and of said recess in said housing and the other of said pin and said recess in said control body and said pin engaged in said recess to prevent rotation of said control body relatively to said housing beyond the clearance between said pin and the respective portion of the wall of said recess, while said clearance is smaller than the angle of rotation of said control body in said housing at which the respective portions of the outer faces of the control body would touch the respective portions of the inner faces of the seats in said housing.

Or, as is explained by FIGS. 12 to 14 and the description thereof;

that a pin is fastened in the housing and engaged in a recesss in said control body to prevent rotation of a control body which has exclusively centric portions.

And, as explained at hand of FIGS. 19 to 23;

that said means is the provision of at least two portions engaging at least into two recesses, said provision centers around the pressure center "Gc" of the said control face and one of said portions and of said recesses is located in said housing and the other of said portions and of said recesses is located in said control body.

And, as explained in FIGS. 6 to 8 and the description thereof:

that means are provided on the control body to prevent sticking of the control body under forces appearing along the control face during slide of the rotary slide face over the control face, and while said control face is provided with a medial recess, said control body has exclusively one front seat and one rear seat in said housing, at least said rear seat is eccentric relatively to the axis of said rotor, a first chamber is formed between said seats and a second chamber is formed on the rear of said rear seat, said second chamber is communicated to said medial recess, said chambers have different cross-sectional areas, each of said chambers communicates separatedly with the respective control port of said control face and the cross sectional area of said second chamber covers the area of the control zone around the aligned control port plus the area of the said medial recess and its seal while the cross-sectional area of said first chamber covers the area of the control zone around the other control port of said control ports.

and, that said control zone around said other control port forms a usual pressure center "Gco", but the said respective control zone forms a more radially inwardly relatively to the other "Gc" located pressure center "Gci" by the combination of said respective control zone and said medial recess, while the pressure center "gco" of said first chamber is located axially kof said "Gco"—center, but the pressure center "gci" of said second chamber is located axially of said more inwardly located pressure center "Gci" of said control face.

And, as explained in FIGS. 9 to 11 or 15 to 17 nd the description thereof, that said control face forms substantially the usual basic first pressure control half and second pressure half with said halfs forming seal faces around their respective control ports and with substantially closed control archs between said substantial halves for the pre-compression and expansion or sudden pressure change in the respective working spaces, which are controlled by said halfs of said control face but wherein at least one additional recess is provided in addition to the respective control port in the respective half and said recess communicates with the control port in the first pressure half when it is located in the second pressure half and communicates with the control port of the second pressure half when it is located in the first pressure half, wherein said at least one recess forms a recess-pressure center "Gcr" while the respective pressure center "Gc" of the communicated control half forms in combination with said center "Gcr" a combined and relatively to said center "Gc" radially inwardly displaced summarized pressure center "Gcs" and the respective pressurized chamber which is communicated to the respective control port provides with a cross sectional area substantially able to cover the fluid pressure areas of said respective control port and of said respective recess and which forms a pressure center "gcs" substantially axially of said summarized pressure center "Gcs" of said control face, and wherein said substantially is of such a high degree of accuracy, that it forms said means to prevent said sticking of said control body.

And, that said accuracy exceeds ninety percent of the equalness to the equations (1) to (4) of this specification.

And, that in combination with the specifities which are shown in FIGS. 9 to 17, a central bore extends through said control body and through said control face and into a room of substantial low pressure.

Or, as explained at hand of FIGS. 9 to 26;

that said at least one additional recess consits of a first recess and a second recess, said first recess is located in said second pressure half but communicated with the control port in said first pressure half; said second recess is located in said first pressure half but communicated with the control port of the second pressure half to form by said locations and said communications first and second summarized control face pressure centers "Gco's" and "Gci's";

wherein said at least one pressureized fluid containing thrust chamber consists of at least two separated thrust chambers whereof one is the outer chamber and the other is the inner chamber; wherein each of said chambers substantially covers by a respective balancing factor "fb" the area of the the respective summarized area "Gc's" of the control face on the other end of the control body;

and, wherein the pressure center "gco" of the said outer thrust chamber is located axially of the respective summarized pressure center "Gco's" of the control face and the pressure center "gci" of the said inner thrust chamber is located axially of the respective summarized pressure center "Gci's" of the control face on the other end of the control body.

or, that said outer and inner chambers are eccentrically relatively to each other and to the axis of said rotor.

Or, as demonstrated in FIG. 18, that said first and second recesses are separated from each other by a relatively narrow sealing land of parallel ends and said recesses have auter walls bordering sealing lands around said recesses which border on the respective control ports and are substantially parallel to the inner walls of said control ports in order to obtain a maximum of utilization of the said control face.

Or, as shown in one or more of the Figures, for example, as seen in FIGS. 9 to 11, that said summarizations obtain the sum of zero, whereby said summarized pressure centers "Gcos" and "Gcis" are becoming the distance zero from the axis of the rotor and thereby becoming equal to the axis of the rotor and as the result of the condition of axiality of centers "gco" and gci" between the centers "Gco" and "gci" the said inner chambers and outer chambers of said at least one thrust chamber are becoming centric chambers with pressure centers "gco" and "gci" equal to zero.

And, as FIGS. 9 to 11 show, that said recesses of said at least one recess are provided with separated passages which extend through said control body from the respective recess into the respective chamber of said thrust chambers.

Or, as seen in FIGS. 15 to 17 and 24 to 26, that said passages have cross-sectional areas of sufficient size to facilitate the passage of a flow of fluid through said passages and whereby said recesses thereby are transformed to additional third and fourth control ports for control of a second flow of fluid through said control body into and out of at least one second group of working chamber spaces in said rotor of said device.

Which Figures also show, that said control ports form flow control pairs with an entrance- and an exit-control port to each flow of said flows.

Or, that two of said entrance ports are located in one of said substantial halves and two of said exit ports are located in the other of said substantial halves of said control port areas of said control face.

And, as FIG. 26 demonstrates, that each of said substantial halves of control zones of said control face contains at least one separated entrance control port and at least one separated exit control port and at least two of said passages through said control body incline radially outwardly or inwardly within said control body to communicate with a respective chamber of said chambers radially of the respective control port.

In FIGS. 28-A to 29-E more mathematical schematics with equations are shown as additional possibilities to calculate the control body arrangement exactly. These Figures illustrate the newer discoveries of the applicant for partially simplified calculation systems of the control body arrangement. The basic explanation is given at FIG. 28-A. FIG. 28-A is thereby the summary of the detailed explanations of the other portions of FIGS. 28-A to 29-E. Based on this consideration of FIG. 28-A, the area which rvolves around an axis leads finally to the simple equations belonging FIGS. 28-A to 29-E to find the pressure centers of the respective rear shoulder faces or of the pressure chambers (thrust chambers) of the control body arrangement of the invention. It might be understood that the results of these new equations to FIGS. 28-A to 28-E are the same as that of the earlier discussed calculations. The systems of FIGS. 28-A to 29-E are applicable, however, only under the geometrical conditions which are shown in these Figures while the earlier discussed systems of calculation are applicable generally for all geometrical conditions of the control body arrangements of the invention.

The consequence of FIG. 28-A is, that, if the volume of a body which revolves around an axis is known, the distance of the area center of the body from the axis where around the body revolves, can become calculated by dividing the volume "J" by "2 pi F" with pi=3.14 and F=the area. Thus, the following appears:

$$S=J/2piF$$

with "S"=the distance of the area center from the axis where around the body revolves and, consequently, S would correspond to the value "gc" of the invention.

Figure 31:
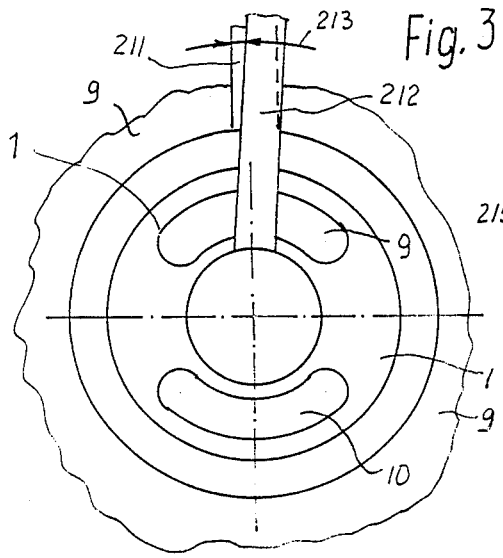
FIG. 31 is a view from the right of FIG. 30 onto FIG. 30.
Figure 30:
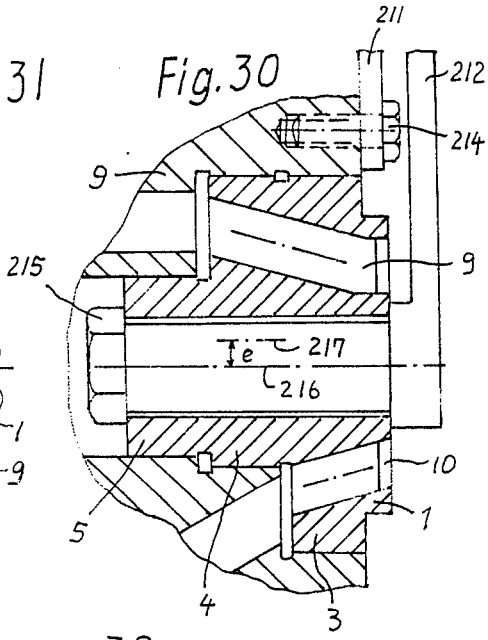
FIG. 30 is a longitudinal sectional view through an arranment with some members shown from the outside.

FIGS. 30 and 31 illustrate an arrangement to determine the angle of pivotal movement at which the control body would bind in the housing portion of the devcie. As it is described in this specification, there is presently no exact system to calculate the angle of pivotal movement at which the control body would or might bind. In a co pending application a rough estimation for such a calculation is given but the estimation is not very accurate since at the pivotal movement of the control body the concentric axis will not remain concentric but depart from its concentric location. The control body may not only pivot slightly but may also move up, down, to the left or right in a limited extent. Thus, an exact calculation of the condition under which the control body would bind in the housing, is not possible, at least not at the present time. If a control body arrangement of the invention shall be properly designed, the condition under which the control body might or would bind, must, however, be known. It is therefore recommended to built a testing arrangement of FIGS. 30 to 31 and use it to determine by test the angle at which the control body binds. For that purpose a lever 211 becomes mounted in radial direction onto the housing portion of the arrangement. A lever 212 becomes mounted in radial direction onto the control body. The mounting may be accomplished by holding means 214 and 215. The levers are set radially aligned with each other at the concentric location of the control body in the housing portion. The lever 212 is then pivoted by hand in the direction of 213 until a further pivotal movement becomes impossible because the control body binds in the housing portion. The angle 213 is then measured. This is the angle of pivotal movement at which the control body binds in the housing portion. Once this angle 213 is measured the permissable clearances for the arresting means of the invention can become calculated and a precise and reliable control body arrangement of the invention can become designed and be built. After the measuring of the angle 213 has been done, the lever 212 can become moved back into its original zero position. The binding of the control body in the housing is then removed and the control body can be taken out of its housing portion. The fasteners 214 and 215 can then be taken off and the arrangement can be used. It is of interest that for every actual design of measures of a control body the here described measurement of the binding angle of the arrangement has to be done only one time. Since therefrom the angle at which the respective control body will bind, has become determined, every control body arrangement of the same dimensions will be free from binding in the housing portion, if the results of the measurement and its consequences for the actual design and building are obeyed.

Figure 32:
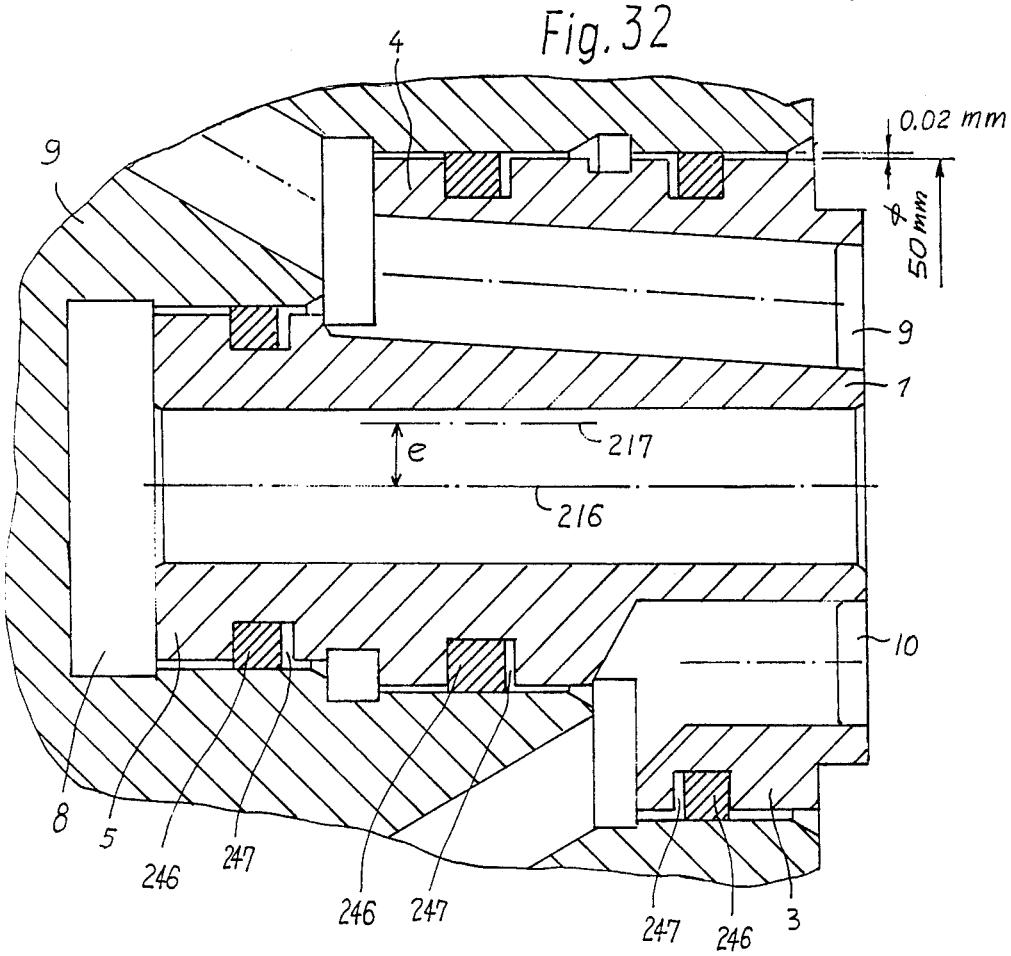
FIG. 32 is a longitudinal sectional view through a controlbody in an enlarged scale with some actual mea- written in the Figure.

FIG. 32 illustrates a control body of FIGS. 1 to 3 in a longitudinal sectional view in a very dratsically enlarged scale. In the Figure some measures are disclosed to illustrate the actual dimension as an example. The speciality of this Figure is that plastically deformable seal rings 246 are inserted in seal ring seats 247 of the control body.

The seal rings 246 are here made of a plastic material which exceeds 70 shore scale "A" hardness but remains below 96 shore scale "A" hardness. This specific hardness of the seal rings 246 provide a certain holding and concentering effect for the control body 1 in its surrounding housing portion 9. By applying the mentioned seal rings in the mentioned seal seats the seal rings provide a prevention of pivotal movement and of binding of the control body if the machining and design is very accurate and if the balancing factor "fb" is 1.04 plus/-minus 0.3. and if the pressure in the device remains less than 300 Kilograms per centimeter squared, the greatest diameter of the control body remains less than 60 millimeter and the revolution of the rotor of the device is less than 3000 revolutions per minute. The referential numbers of FIGS. 30 to 32 which are here not discussed, are known from the description of other Figures of the present patent application. More details of the preferred embodiment are described in the appended claims. The claims therefore are considered to be a portion of the description of the preferred embodiments.

What is claimed is:

1. A control arrangement in a device which takes in and expels fluid through passages and ports and through working spaces located in a rotor which is revolvably borne in a housing, at least one rotary slide face is formed on a portion of the rotor, at least one pressurized fluid containing thrust chamber formed in a portion of the housing and communicated to at least one of the passages, a control body inserted at least partially into the thrust chamber with a rear shoulder towards the interior of the thrust chamber and forming a non-rotary control face of the front end of the control body with said control face interrupted by control ports to control the flow of fluid to and from the working spaces and through said rotary slide face while the pressurized fluid in the respective thrust chamber presses the control body towards the rotor to seal with said control face along said rotary slide face when the rotary slide face slides and revolves over said control face of said control body, wherein the respective thrust chamber forms a pressure center axially behind the respective pressure center of the respective pressure zone of the control face, wherein said control face is provided with a medial recess, said control body has exclusively one front seat and one rear seat in said portion of said housing, at least said rear seat is eccentric relative to the axis of said rotor, a first chamber is formed between said seats and a second chamber is formed on the rear of said rear seat, said second chamber is communicated to the second control port and to said medial recess, said chambers have different cross-sectional areas, each of said chambers communicates separately with the respective control port of said control face and the cross sectional area of said second chamber covers the area of a pressure zone around said second control port plus the area of the said medial recess and its seal face while the cross-sectional area of said first chamer covers the area of a pressure zone around the first control port of said control ports, with said first control port communicated to said first chamber, and, wherein said front seat is concentrically located around a first eccentric axis of said front seat with said first eccentric axis slightly radially distanced from the concentric axis of said rotor by a first eccentricity, while the rear seat is concentrically located around a second eccentric axis which is parallel to said first eccentric axis and parallel to said concentric axis of said rotor but radially distanced from both of said axes while all said three axes are parallel to each other, whereby said first chamber has an eccentric outer diameter and an eccentric inner diameter respective to said concentric axis of said rotor, while said second chamber has an outer diameter which is located eccentrically relative to said concentric axis of said rotor but circular around said second eccentric axis.

2. A control arrangement in a device which takes in and expels fluid through passages and ports and through working spaces located in a rotor which is revolvably borne in a housing, at least one rotary slide face is formed on a portion of the rotor, at least one pressurized fluid containing thrust chamber formed in a portion of the housing and communicated to at least one of the passages, a control body inserted at least partially into the thrust chamber with a rear shoulder towards the interior of the thrust chamber and forming a non-rotary control face on the front end of the control body with said control face interrupted by control ports to control the flow of fluid to and from the working spaces and through said rotary slide face while the pressurized fluid in the respective thrust chamber presses the control body towards the rotor to seal with said control face along said rotary slide face when the rotary slide face slides and revolves over said control face of said control body, wherein the respective thrust chamber forms a pressure center axially behind the respective pressure center of the respective pressure zone of the control face, wherein said control face is provided with a medial recess, said control body has exclusively one front seat and one rear seat in said portion of said housing, at least said rear seat is eccentric relative to the axis of said rotor, a first chamber is formed between said seats and a second chamber is formed on the rear of said rear seat, said second chamber is communicated to the second control port and to said medial recess, said chambers have different cross-sectional areas, each of said chambers communicates separately with the respective control port of said control face and the cross sectional area of said second chamber covers the area of a pressure zone around said second control port plus the area of the said medial recess and its seal face while the cross-sectional area of said first chamber covers the area of a pressure zone around the first control port of said control ports, with said first control port communicated to said first chamber, wherein said pressure zone around said first control port, which is communicated to said first chamber, forms a usual pressure center "Gco", while the pressure zone around said second control port, which is communicated to said second chamber, forms a more radially inward relative to the other "Gco" located pressure center "Gci" by the combination of the respective pressure zone with said medial recess, while the pressure center "gco" of said first chamber is located exactly axially of said "Gco" center, but the pressure center "gci" of said second chamber is located axially of said more inwardly located pressure center "Gci" of said control face, and, wherein said front seat is concentrically located around a first eccentric axis of said front seat with said first eccentric axis slightly radially distanced from the concentric axis of said rotor by a first eccentricity, while the rear seat is concentrically located around a second eccentric axis which is parallel to said first eccentric axis and parallel to said concentric axis of said rotor but radially distanced from both of said axes while all said three axes are parallel to each other, whereby said first chamber has an eccentric outer diameter and an eccentric inner diameter respective to said concentric axis of said rotor, while said second chamber has an outer diameter which is located eccentrically relative to said concentric axis of said rotor but circular around said second eccentric axis.

* * * * *